United States Patent [19]

Schultz

[11] Patent Number: 4,558,904

[45] Date of Patent: Dec. 17, 1985

[54] HOOP CHAIR

[76] Inventor: Moses R. Schultz, Box 52, Barto, Pa. 19504

[21] Appl. No.: 478,081

[22] Filed: Mar. 23, 1983

[51] Int. Cl.[4] ..... A47C 7/00

[52] U.S. Cl. ..... 297/441; 5/402; 160/402; 160/DIG. 15; 297/218; 297/452; 297/455; 297/457

[58] Field of Search ..... 297/441, 457, 455, 456, 297/218, 226, 452; 5/402, 407, 411; 160/402, 399, 380, DIG. 15

[56] References Cited

U.S. PATENT DOCUMENTS

| | | | |
|---|---|---|---|
| 1,400,717 | 12/1921 | Benson et al. | 297/457 |
| 2,151,628 | 3/1939 | Van Derveer | 5/402 |
| 2,343,505 | 3/1944 | Gedris | 160/402 X |
| 3,348,882 | 10/1967 | Chassaignac | 297/441 X |
| 3,586,370 | 6/1971 | Barecki | 297/457 X |
| 3,601,446 | 8/1971 | Persson et al. | 297/457 X |
| 3,677,601 | 7/1972 | Morrison et al. | 297/457 X |
| 4,018,479 | 4/1977 | Ball | 297/441 X |
| 4,062,590 | 12/1977 | Polsky et al. | 297/457 X |
| 4,296,964 | 10/1981 | Haack | 297/441 X |

*Primary Examiner*—Philip C. Kannan
*Attorney, Agent, or Firm*—Cushman, Darby & Cushman

[57] ABSTRACT

A chair is provided that supplies good seat and back support and comfort, while being aesthetic and providing ready replacement of the seat and/or back upholstery. A frame component substantially defines the periphery of the chair seat or back, and cooperates with a clamping component to hold upholstery in place defining the seat or back. The upholstery comprises a fabric body and a welt of flexible but relatively incompressible material attached to the periphery of the fabric. The frame component and clamping component hold the fabric therebetween so that the welt is on the opposite side thereof from the seat, the fabric being held tight. The area encompassed by the frame component may be readily adjusted to allow ready detachment of the clamping component, and replacement of the upholstery. A bridge spans opposite sides of the clamping component, and a downwardly extending shaft attached to the bridge is received by a base to provide support for the frame component.

13 Claims, 9 Drawing Figures

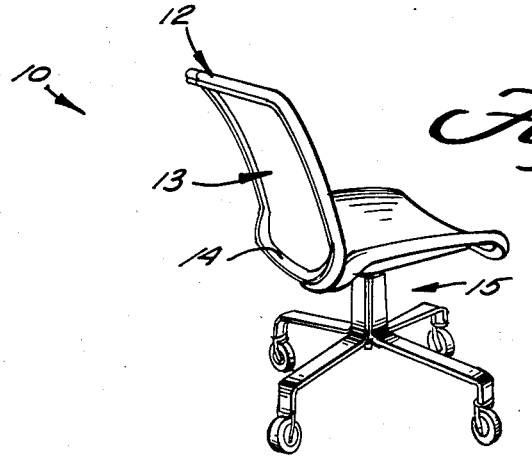
Fig. 1
Fig. 2
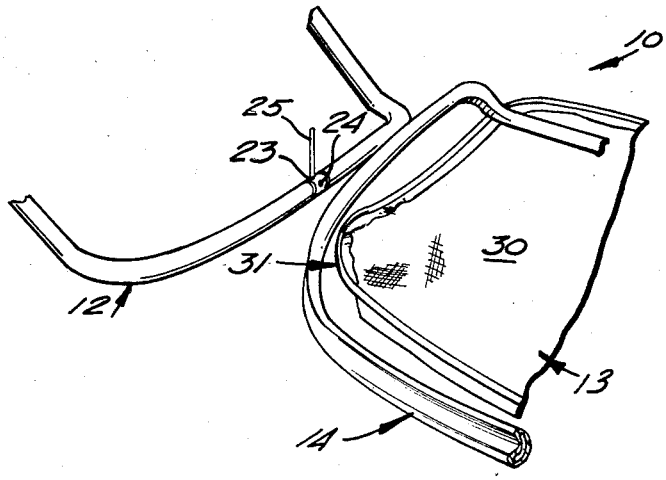
Fig. 3
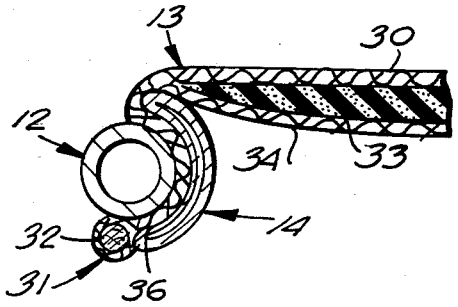
Fig. 4
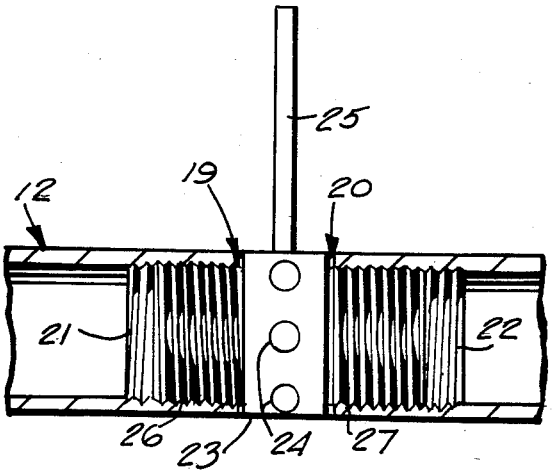

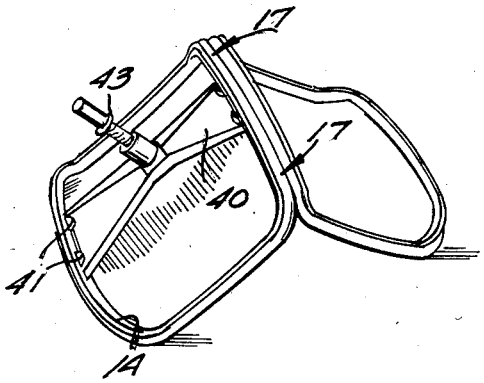
Fig. 5
Fig. 6
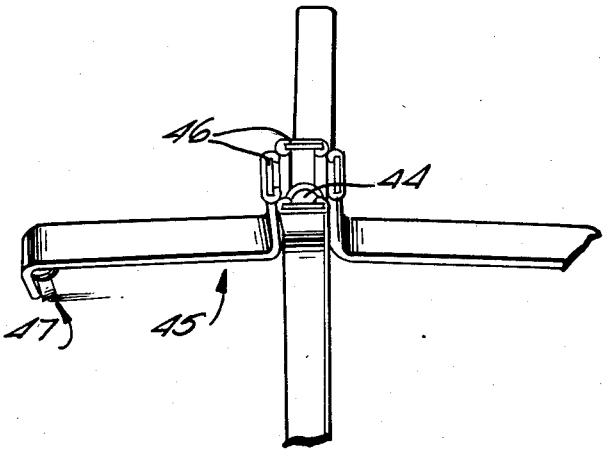
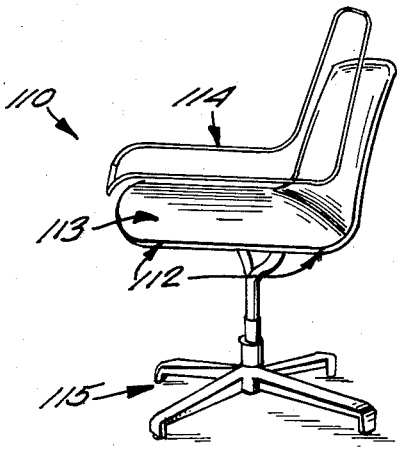
Fig. 7
Fig. 8
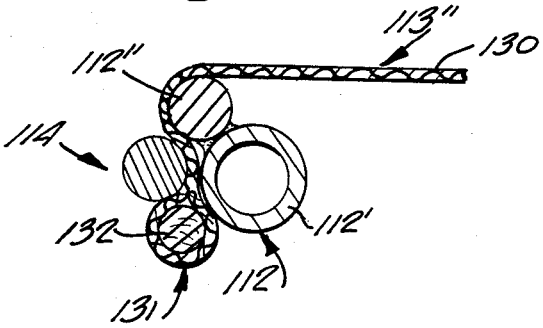
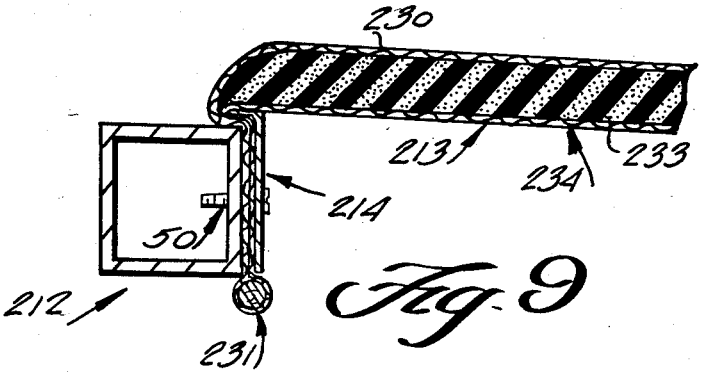
Fig. 9

HOOP CHAIR

BACKGROUND AND SUMMARY OF THE INVENTION

According to the present invention a chair is provided that has numerous desirable characteristics. A chair according to the invention is simple and easy to manufacture, is aesthetic, and provides good support for the user. The seat portion of the chair is comfortable, and the back portion provides good support to the lumbar region of the user's back. Further, the chair is constructed so that should the material forming the seat or back thereof become worn, destroyed by accident, or no longer aesthetically acceptable, it may be readily replaced without the need to send the chair to a factory, and without the employment of skilled labor.

The basic structures of the chair according to the invention comprise a frame component, upholstery means, and clamping means, with a supporting means mounting the frame component off the ground.

The frame component defines substantially the periphery of a chair seat and/or back portion. The frame component may take a wide variety of configurations but in the preferred embodiment is a metal tube that is circular in cross-section.

The upholstery means includes a body forming the actual seat and/or back of the chair, and a welt formed substantially around the entire periphery of the body. The upholstery means body preferably comprises an appropriately dimensioned piece of fabric, and may include a foam and a backing material attached thereto. The welt comprises a flexible, but relatively incompressible material, such as rope or cord, which is attached to the fabric (e.g. sewn into) around the periphery thereof.

The clamping means may also take a wide variety of configurations, and includes a clamping component that cooperates with the frame component to clamp the upholstery body therebetween, with the welt preventing the upholstery from being pulled between the clamping component and frame component when the seat and/or back are subjected to the forces that commonly exist when an individual sits in the chair. In the preferred embodiment, the clamping component comprises a ring disposed interiorly of the frame tube, and having a concave substantially half-circular configuration, the diameter of the circle being greater than the diameter of the frame tube. The inner ring is inserted into operative association with the frame hoop when the hoop has been adjusted to define a substantially large area, and when the hoop is then adjusted to close up the area it defines, the upholstery body is tightly clamped between the hoop and the ring.

The support for the chair comprises a bridge which spans opposite sides of the inner ring, and includes a downwardly extending shaft. The shaft is received in a base portion, such as a metal base portion clad with a vinyl extrusion, and the base may or may not include wheels.

It is the primary object of the present invention to provide a versatile, simple, aesthetic, and comfortable chair. This and other objects of the invention will become clear from an inspection of the detailed description of the invention, and from the appended claims.

BRIEF DESCRIPTION OF THE DRAWINGS

FIG. 1 is a rear perspective view of an exemplary chair according to the present invention;

FIG. 2 is a partial perspective view of major components of a chair of FIG. 1 when disassembled;

FIG. 3 is a partial side cross-sectional view showing the interrelationship between main components of the chair of FIG. 1;

FIG. 4 is a side view, partly in cross-section and partly in elevation, showing exemplary adjustment means for the frame component hoop of the chair of FIG. 1;

FIG. 5 is a bottom perspective view, with the base removed for clarity, of the chair of FIG. 1;

FIG. 6 is a top detailed perspective view of the base of the chair of FIG. 1;

FIG. 7 is a partially exploded perspective view of another embodiment of the chair according to the present invention;

FIG. 8 is a side detailed cross-sectional view of the major components of the chair of FIG. 7 when in assembled configuration; and FIG. 9 is a detailed side cross-sectional view of major components of another embodiment of the chair according to the present invention.

DETAILED DESCRIPTION OF THE DRAWINGS

FIGS. 1 through 6 illustrate various views, and components, of a first exemplary chair 10 according to the present invention. Major components of the chair 10 include a frame component 12, upholstery means 13, a clamping component 14, and a supporting means 15.

The frame component is shown most clearly in FIGS. 1 through 4, and preferably comprises a tubular metal hoop having a circular cross-section and substantially defining the periphery of the chair 10 seat or back. A pair of the frame components 12 are welded, or otherwise attached, together, as at points 17 (see FIG. 5) to define both the seat and back of the chair 10.

Adjustment means are provided for adjusting the area defined by the hoop 12. Preferred exemplary adjustment means are seen most clearly in FIGS. 2 and 4. The hoop 12 includes a pair of open ends 19, 20 that are adjacent each other. As the ends 19, 20 are moved toward each other the area defined by the hoop 12 decreases, and as the ends 19, 20 are moved away from each other the area increases. End 19 is formed with left-hand internal threads 21, while end 20 is formed with right-hand internal threads 22. The adjustment means further comprises a cylindrical body member 23 which has an exterior diameter substantially the same as the exterior diameter of the hoop 12, and includes a plurality of radially-extending openings 24 therein.

A handle 25 is adapted to be inserted in the openings 24, and once inserted therein rotation of the handle 25 effects rotation of the body 23. Extending axially outwardly from the ends of the body 23 are first and second exteriorly threaded shaft portions 26, 27. The exterior threads on the shaft portion 26 cooperate with the internal threads 21, and the exterior threads on the shaft portion 27 cooperate with the internal threading 22. It will thus be seen that by rotation of the body 23 in one direction, utilizing handle 25, the hoop ends 19, 20 will be moved away from each other, while upon rotation in the opposite direction the ends 19, 20 will be moved toward each other.

Preferably the hoop 12 is formed so that it has four open ends, comparable to the ends 19, 20, with an adjustment body 23, etcetera provided in cooperation with each pair of open ends. One adjustment structure 23 is preferably located on one side of the seat or back, while another structure 23 is located on the opposite side of the seat or back. In this way the maximum ready adjustability of the chair frame component is provided.

The upholstery means 13 are best illustrated in FIGS. 1 through 3. The upholstery means comprise a body portion which actually forms the seat or back of the chair 10. The body preferably is formed by an appropriately dimensioned section of fabric 30. A welt, shown generally by reference numeral 31 (see FIG. 3) is formed around substantially the entire periphery of the body 30. The welt preferably comprises an elongated piece of flexible but relatively incompressible material 32 that is fixed to the periphery of the fabric 30. Typical materials for the welt are rope or cord. A typical manner of attachment of the welt or cord 32 to the fabric 30 is illustrated in FIG. 3, wherein the edge of the fabric 30 is looped around the cord or rope 32 and the looped portion of fabric 30 is sewn to another portion of the fabric 30.

If desired, the body of the upholstery means 13 may also be formed by other components. For instance the fabric 30 may be laminated or otherwise attached to a piece of foam 33, which in turn is attached to a base 34. Preferably the base 34 is of flexible material, such as another piece of fabric, leather, or the like.

The clamping component 14 comprises clamping means for clamping a peripheral portion of the fabric 30 between it and the hoop 12, as illustrated most clearly in FIGS. 1 and 3. The clamping is effected so that the clamping component 14 and hoop 12 act upon the welt 31 (e.g. abut it), the relative non-compressibility of the welt 31 preventing it from passing between the hoop 12 and the clamping component 14. Thus the fabric 30 is held taut, serving appropriately as a seat back cover.

In the preferred embodiment illustrated in FIGS. 1 through 3 and 5, the clamping component 14 comprises an inner ring which has substantially a half-circular configuration, cooperating with that of the hoop 12. As seen most clearly in FIG. 3, the half-circular configuration of the inner ring 14 concave exterior 36, has a diameter generally greater than, or equal to, the diameter of the hoop 12.

Preferred means for supporting the chair 10 are illustrated most clearly in FIGS. 1, 5, and 6. Such means include a bridge 40 which spans the distance between opposite sides of the inner ring 14, and is attached thereto. A plurality of abutments 41 may be provided on opposite sides of the bridge 40 for engaging the inner ring 14, the abutments 41 being adjustable (as by loosening a screw fastener) to provide clamping action with, or removability from, the inner ring 14.

Extending downwardly from the bridge 40 is a shaft 43. The shaft 43 is received within a collar 44 formed in the interior of a base member 45. Cooperating screw threads may be formed on the bottom exterior of the shaft 43, and on the interior of the collar 44. The base 45, as illustrated most clearly in FIG. 6, preferably comprises metal supporting body portions 46, including legs to which castors 47 are attached. The metal components 46 are clad with a plastic (e.g. vinyl) extrusion. This may be accomplished by heating the extrusion in boiling water, applying it to the metal components 46, and allowing it to cool.

For the embodiment of chair illustrated in FIGS. 7 and 8, components corresponding to like components of the embodiment illustrated in FIGS. 1 through 6 are indicated by the same reference numeral only preceded by a "1".

In the embodiment of FIGS. 7 and 8, the frame component 112 of the chair 110 substantially defines the periphery of both the chair seat and back. The frame component 112 preferably comprises a first metal tube 112' (see FIG. 8) having a circular cross-section, to which is welded, or otherwise attached, a circular-cross-section rod 112", the rod 112" being in tangential engagement with the tube 112'.

The upholstery means 113 in this embodiment are substantially the same as the upholstery means in the FIGS. 1 through 6 embodiment, except that the upholstery means fabric body 130 is configured and dimensioned to cover both the seat and back of the chair 110. A welt 131, defined by flexible but relatively incompressible material 132, is formed around the periphery of the fabric 130, and is clamped between the frame component 112 and the clamping component 114. The clamping component 114 comprises a retaining hoop which fits under the "undercut" formed by the rod 112". The components can be configured so that the retaining hoop 114 is elastically deformed into the clamping position illustrated in FIG. 8, or the retaining hoop 114 can be formed in sections, or with a split end, and screwed or otherwise attached to the tube 112'.

The components illustrated in the embodiment of FIG. 9 may be used as an alternative to those in the FIGS. 1 through 6 embodiment, or the FIGS. 7 and 8 embodiment. Structures in the FIG. 9 embodiment comparable to those in the FIGS. 1 through 6 embodiment are referred by the same reference numeral only preceded by a "2".

In the FIG. 9 embodiment the frame component 212 preferably comprises a tubular component which may have a variety of cross-sections, such as the substantially square cross-section illustrated in FIG. 9. The upholstery means 213 is substantially identical to the upholstery means 13, comprising a fabric component 230, welt 231, foam portion 233, and substrate 234. The clamping component 214 takes the form of a plurality of sections of metal angle iron, having configurations cooperating with the external configuration of the frame tube 212. For instance four angle iron sections 214 may be provided associated with each of the seat and back portions of the chair, with the frame component 212 a continuous tube. At predetermined spaced locations along each of the angle irons 214, they are attached to the tube 212 by fastening means, such as screws 50, which pass through a portion of the fabric 30 adjacent the welt 231 also.

In each embodiment of the chair according to the invention, the shape of the frame component 12, 112, 212 and the clamping component 14, 114, 214, is designed, and the upholstery fabric 30, 130, 230 is cut and dimensioned, so as to provide proper support and comfort for an individual utilizing the chair. For example, the seat is constructed so that a front to back centerline contour is full and convex, and the back is configured so that a horizontal contour across the back is concave and the vertical centerline contour is configured so as to give good support to the lumbar region of the user's back. Comfort is thus obtained thereby that is much greater than that obtained from conventional sling chairs. Further, the upholstery means 13, 113, 213 according to the present invention are readily replaceable should the fabric 30, 130, 230 wear out, be damaged, or no longer be aesthetically acceptable to the user.

Assembly Operation

Exemplary apparatus according to the invention having been described, an exemplary assembly operation thereof will now be described with respect to the FIGS. 1 through 6 embodiments.

The outer hoop 12 of a chair seat-defining component is welded, as at point 17, to the outer hoop 12 of a back-defining chair portion. For each of the back and seat portions the cylindrical adjustment body (bodies) 23 is (are) rotated utilizing handle 25, to move the ends 19, 20 away from each other. Once they are moved an appropriate distance from each other, the uphosltery means 13 are moved into place within the area defined by the hoop 12, with the welt 31 on the exterior side of the hoop 12. The inner ring 14 is then inserted within the area defined by the hoop 12, with the concave half-round face 36 thereof abutting a portion of the fabric 30 adjacent the welt 31, around the entire interior periphery of the hoop 12. The adjustment means body (bodies) 23 is (are) then rotated in the opposite direction, again using handle 25, to move the ends 19, 20 closer to each other until the hoop 12 is tightened up, the inner ring 14 and hoop 12 preventing movement of the welt 31 therebetween.

The bridge 40 is then moved into operative association with the inner ring 14, with abutments 41 holding it in place, and the shaft 43 is screwed into the collar 44 of base 45. The chair is then ready for use, and will comfortably support an individual sitting thereon and leaning back thereon.

It will thus be seen that according to the present invention a chair has been provided which is easy to construct, comfortable, aesthetic, and versatile. While the invention has been herein shown and described in what is presently conceived to be the most practical and preferred embodiments thereof it will be apparent to those of ordinary skill in the art that many modifications may be made thereof within the scope of the invention. For instance the chair may be provided with arms, a foot rest, or the like, and the details of the configurations of all of the components may vary widely. Thus the invention is to be accorded the broadest interpretation of the appended claims so as to encompass all equivalent structures and devices.

What is claimed is:

1. A chair comprising:

a metal frame component substantially defining the periphery of a chair seat or back;

upholstery means, having a fabric body portion forming a seat or back of the chair, and a welt formed around substantially the periphery of said body portion, said welt comprising a flexible, but relatively incompressible material, such as rope or cord, operatively attached to the fabric around the periphery thereof;

clamping means for cooperating with the frame component for holding the upholstery means to the frame so that the welt is on the opposite side of the clamping means and frame from the upholstery means body portion, said clamping means including a clamping component having a peripheral configuration cooperating with the frame component to operatively hold said upholstery means therebetween; and means for supporting said frame component off the ground.

2. A chair comprising:

a metal circular cross-section frame component substantially defining the periphery of a chair seat or back;

upholstery means, said upholstery means having a body portion forming a seat or back of the chair, and including a welt formed around substantially the periphery of said body portion;

clamping means for cooperating with said frame component for holding said upholstery means so that said upholstery means body remains in place defining an operative chair seat or back portion, said clamping means consisting of a clamping component having a peripheral configuration cooperating with said frame component to operatively hold said upholstery means therebetween; said clamping component comprising an inner ring having a substantially half-circular concave peripheral cross-section so that said clamping component and said frame component clamp said upholstery means therebetween so that said welt is disposed on the opposite side of said ring and said frame from said body of said upholstery means; and means for supporting said frame component off the ground.

3. A chair as recited in claim 1 wherein said frame component comprises a tubular hoop, and means for adjusting the seat or back portion area defined by the periphery of said hoop.

4. A chair as recited in claim 2 wherein said frame hoop has a pair of adjacent open end portions; and wherein said adjustment means comprises internal threading formed in said frame hoop at said open end portions, the threading in one open end portion being left-handed and the threading in the other open end portion being right-handed; a connector connecting said open end portions, said connector comprising a central rotatable body portion, and a pair of shaft portions extending outwardly from opposite sides of said body portion, one of said shaft portions being threaded for cooperation with said hoop open end left-handed internal threads, and the other of shaft portions having external threading for cooperating with said hoop open end right-handed internal threads.

5. A chair as recited in claim 3 wherein said frame component and said clamping component provide a chair seat portion; and wherein said means for supporting said frame component off the ground comprises: a bridge operatively connected to, and extending between, opposite interior portions of said clamping component, said bridge including a vertically downwardly extending support shaft; and a base portion for operatively receiving said support shaft.

6. A chair as recited in claim 1 wherein said upholstery means body comprises a fabric, and wherein said welt comprises a flexible, but relatively incompressible material, such as rope or cord operatively attached to said fabric around the periphery thereof.

7. A chair as recited in claim 6 wherein said upholstery means body further comprises a foam material, and a backing material, attached to said fabric body.

8. A chair as recited in claim 2 wherein said upholstery body portion comprises a fabric held taut by said frame component and clamping means operatively acting upon said welt; and wherein a first frame component, upholstery means, and clamping means comprises the chair seat, and a second frame component, upholstery means, and clamping means comprises the chair back; said seat having a centerline contour that is full and convex, and said back having a horizontal contour that is concave and a vertical centerline contour providing good support to the lumbar region of a chair-user's back; and means for attaching said first frame component to said second frame component.

9. A chair comprising:

a frame component substantially defining the periphery of a chair seat or back and comprising a metal circular cross-section tubular hoop having a pair of adjacent open end portions;

upholstery means, said upholstery means having a body portion forming a seat or back of the chair, and including a welt formed around substantially the periphery of said body portion;

clamping means for cooperating with said frame component for holding said upholstery means welt so that said upholstery means body remains in place defining an operative chair seat or back portion, said clamping means including a clamping component having a peripheral configuration cooperating with said frame component to operatively hold said upholstery means therebetween;

means for supporting said frame component off the ground; and means for adjusting the seat or back portion area defined by the periphery of said hoop, comprising internal threading formed in said frame hoop at said open end portions, the threading in one open end portion being left-handed and the threading in the other open end portion being right-handed; a connector connecting said open end portion, said connector comprising a central rotatable body portion, and a pair of shaft portions extending outwardly from opposite sides of said body portion, one of said shaft portions being threaded for cooperation with said hoop open end left-handed internal threads, and the other of shaft portions having external threading for cooperating with said hoop open end right-handed internal threads.

10. A chair as recited in claim 9 wherein said body portion comprises a cylindrical component having substantially the same exterior diameter as the exterior diameter of said frame component hoop, and comprising means defining a plurality of radially extending passageways therein for receipt of a handle for effecting rotation thereof.

11. A chair as recited in claim 10 wherein said clamping component comprises an inner ring having a substantially half-circular concave peripheral cross-section; and wherein said clamping component and said frame component clamp said upholstery means therebetween so that said welt is disposed on the opposite side thereof from said body of said upholstery means.

12. A chair as recited in claim 11 wherein said upholstery means body comprises a fabric, and wherein said welt comprises a flexible, but relatively incompressible material, such as rope or cord, operatively attached to said fabric around the periphery thereof.

13. A chair comprising:

a generally circular cross-section frame component defining substantially the periphery of a chair seat and back;

upholstery means forming the seat and back of said chair, including a body defining the chair seat and back, and a welt formed around substantially the entire periphery of said body;

clamping means for clamping said upholstery means body to said frame component so that said welt is disposed on the opposite side of said frame component from said seat and back, said clamping means consisting of a clamping component having a peripheral configuration corresponding to the peripheral configuration of said frame component; said clamping component comprising an inner ring having a substantially half-circular concave peripheral cross-section so that said clamping component and said frame component clamp said upholstery means therebetween so that said welt is disposed on the opposite side of said ring and said frame from said body of said upholstery means; and means for supporting said frame component off the ground.

* * * * *